US005157305A

United States Patent [19]

Satoh et al.

[11] Patent Number: 5,157,305

[45] Date of Patent: Oct. 20, 1992

[54] DEFLECTING YOKE FOR TELEVISION RECEIVER

[75] Inventors: Tatsuya Satoh; Shunji Arai, both of Nagaokakyo, Japan

[73] Assignee: Murata Mfg. Co., Ltd., Kyoto, Japan

[21] Appl. No.: 798,654

[22] Filed: Nov. 26, 1991

[30] Foreign Application Priority Data

Nov. 29, 1980 [JP] Japan ..... 2-126871[U]

[51] Int. Cl.[5] ..... H01J 29/56

[52] U.S. Cl. ..... 315/370; 315/8

[58] Field of Search ..... 315/370, 8

[56] References Cited

U.S. PATENT DOCUMENTS 4,853,588 8/1989 Ohtsu et al. ..... 315/8

FOREIGN PATENT DOCUMENTS 0371618 10/1989 European Pat. Off. .

*Primary Examiner*—Theodore M. Blum

*Attorney, Agent, or Firm*—Allegretti & Witoff, Ltd.

[57] ABSTRACT

A deflecting yoke for a television receiver comprises a parallel circuit of leakage magnetic field erasing or cancel coils connected in series with a parallel circuit of horizontal deflecting coils. The leakage magnetic field generated by the horizontal deflecting coils is cancelled by applying a magnetic field in an opposite magnetizing direction. The inductances of the cancel coils can be separately adjusted by adjusting the tap position of an adjusting variable tapped coil connected in series with the cancel coils.

5 Claims, 2 Drawing Sheets

DEFLECTING YOKE FOR TELEVISION RECEIVER

BACKGROUND OF THE INVENTION

1. FIELD OF THE INVENTION

The present invention relates to a deflecting yoke for a television receiver which has cancel coils for erasing a leakage magnetic field.

2. DESCRIPTION OF THE PRIOR ART

A leakage magnetic field is formed in front of a cathode-ray tube of a television receiver in use. A low-frequency magnetic field of 1 to 400 kHz is said to be harmful to the human body and its removal is demanded from the view point of protection of the human body.

A method as shown in FIG. 1 is conventionally proposed. According to this method, a parallel circuit of leakage magnetic field erasing coils (cancel coils) 5*a* and 5*b* is connected in series with a parallel circuit of horizontal deflecting coils 1*a* and 1*b*. A leakage magnetic field generated by the horizontal deflecting coils 1*a* and 1*b* is canceled by applying a magnetic field in an opposite magnetizing direction. Reference symbol A denotes a power supply terminal.

The cancel coils 5*a* and 5*b* are normally provided to bobbin 3 of a deflecting yoke 10 in an inclined manner so that they form an inverted V shape extending from top to bottom sides 13 to 14, as shown in FIG. 2. Reference numeral 2 denotes a vertical deflecting coil toroidally wound on an outer side of the bobbin 3.

The leakage magnetic field canceling/erasing operation by the cancel coils 5*a* and 5*b* will be briefly explained. As shown in FIGS. 2 and 3, when a deflecting current flows in the horizontal deflecting coils 1*a* and 1*b* tending in the top and bottom sides 13 and 14, respectively, of the deflecting yoke 10 in a direction indicated by a straight arrow, a magnetic field B1 is generated, and a magnetic field B2 is generated in a core 4 to generate a low-frequency leakage magnetic field B3 outside the deflecting yoke 10. The cancel coils 5*a* and 5*b* are wound in the same winding direction as those of the horizontal deflecting coils 1*a* and 1*b*. When a current flows in the cancel coils 5*a* and 5*b* via the horizontal deflecting coils 1*a* and 1*b*, a magnetic field B4 in an opposite magnetizing direction to at of the leakage magnetic field B3 is generated by the cancel coils 5*a* and 5*b* to cancel the leakage magnetic field B3. In FIG. 3, reference symbols ⊙ and ⊗ indicate the directions of currents.

The low-frequency leakage magnetic field B3 converges at a neck side 12 along the side surface of the core 4 and disperses from a head side 11 to the front surface of the cathode-ray tube, as shown in FIG. 2. In order to cancel the leakage magnetic field having such a magnetic flux distribution, the cancel coils 5*a* and 5*b* are provided at an inclined angle to form the inverted V shape perpendicular to the leakage magnetic field B3 from the top to bottom sides 13 to 14. The inclined axes of the coils 5*a* and 5*b* are formed on the same plane as that of the deflecting coil 10 and intersect the axis of the deflecting coil 10 on the neck side of the rear surface of the cathode-ray tube.

The cancel coils 5*a* and 5*b* are mounted in the following manner. As shown in FIGS. 4A and 4B, a mounting ring 6 is fitted in a groove formed in the outer surface of the bobbin 3 to regulate its rotation angle with respect to the bobbin 3. Fitting lock mounting portions 9 and 9' are provided on the top and bottom sides of the ring 6.

Mounting leg portions 7 and 7' of the cancel coils 5*a* and 5*b* are fitted and locked in the lock mounting portions 9 and 9'. An inclined angle$\theta'$ is set at a predetermined value. In the arrangement of FIG. 4B, the mounting leg portion 7' and the housing portion of the cancel coil 5*a* are separable.

The canceling effects of the low-frequency leakage magnetic field by the cancel coils 5*a* and 5*b* vary depending on their number of turns (i.e., the inductance), preset angle, and preset position. The preset position is determined by considering the preset angle and the number of turns since it is normally determined by a fitting lock mechanism for a bobbin. However, it is difficult to uniquely determine the preset angles and the numbers of turns (inductance) due to the leakage state of the leakage magnetic field. Accordingly, the numbers of turns of the two cancel coils are separately determined. However, it is very inefficient both in terms of design and manufacture.

SUMMARY OF THE INVENTION

The present invention has been made in view of the above points, and has as its object to provide a deflecting yoke for a television receiver, in which the cancel effect of the cancel coil is adjusted efficiently by a simple operation so that the effect of the cancel coil can be utilized as much as possible.

In order to achieve the above object, according to the present invention, an adjusting variable tapped coil is connected between the power supply terminals of a pair of cancel coils.

The variable coil can be a differential coil.

The inductances of the two cancel coils can be separately adjusted by adjusting the tap position of the adjusting variable coil.

BRIEF DESCRIPTION OF THE DRAWINGS

There is shown in the attached drawing a presently preferred embodiment of the present invention, wherein like numerals in the various view refer to like elements and wherein.

DETAILED DESCRIPTION OF PREFERRED EMBODIMENT

The present invention will be described with reference to the accompanying drawings.

Figure 1:
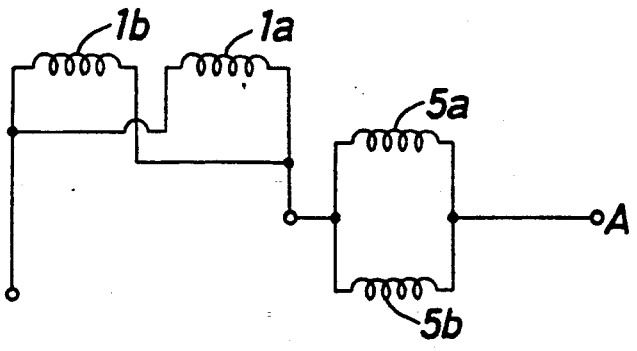
FIG. 1 is a circuit diagram of cancel coils of a conventional deflecting yoke for a television receiver.
Figure 2:
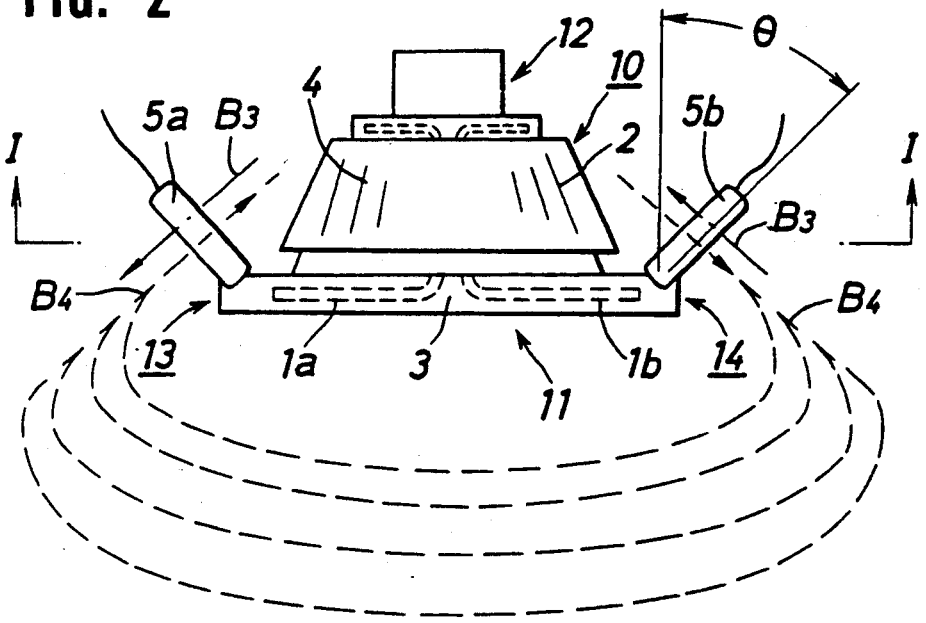
FIG. 2 is a schematic diagram showing the configuration of a conventional deflecting coil having cancel coils and the distribution of a leakage magnetic field.
Figure 3:
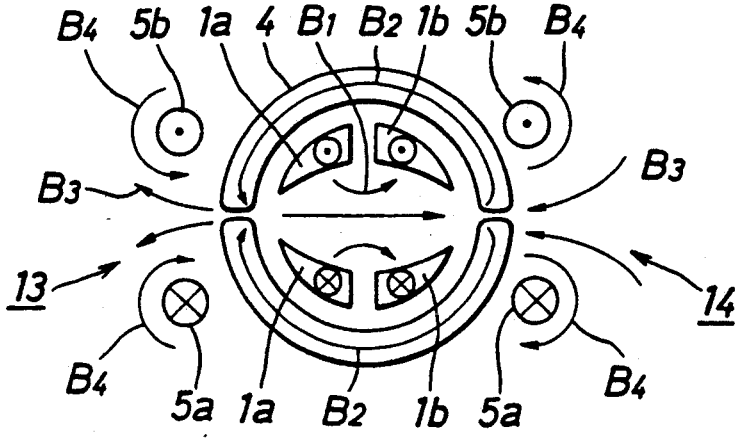
FIG. 3 is a diagram, taken along the line I—I of FIG. 2, showing a state in which the leakage magnetic field and a canceling magnetic field are generated in the conventional deflecting yoke having the cancel coils.
Figure 4A:
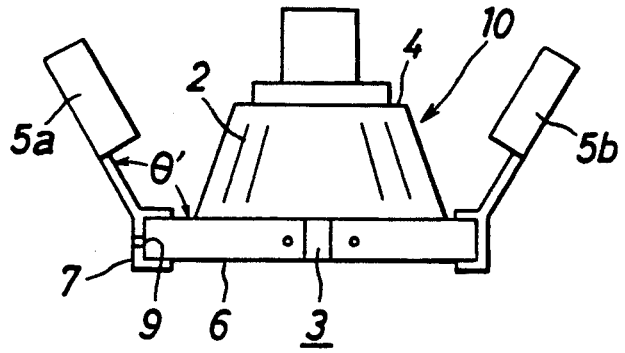
FIGS. 4A and 4B are side views showing a mounting state of the conventional cancel coils.
Figure 4B:
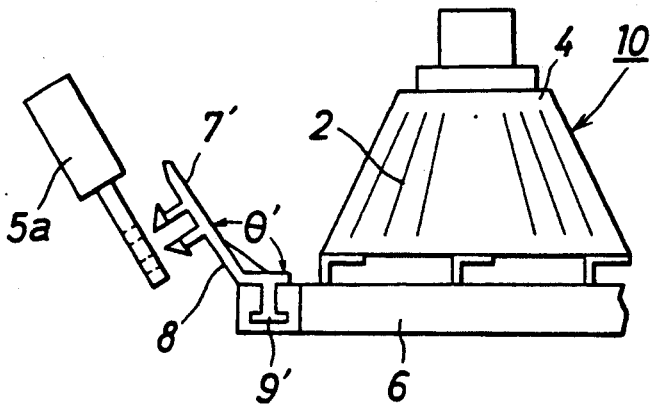
Figure 5:
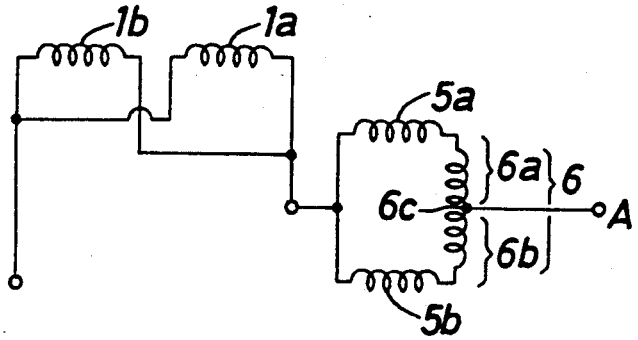
FIG. 5 is a circuit diagram showing the connecting state of cancel coils of a deflecting yoke for a television receiver according to the present invention.

FIG. 5 is a circuit diagram of a deflecting yoke according to the present invention. Referring to FIG. 5, reference numeral 6 denotes a cancel amount adjusting variable coil. Reference numerals 1*a*, 1*b*, 5*a*, and 5*b* denotes components identical to those of the conventional circuit shown in FIG. 1 and thus a detailed description thereof is omitted.

Two terminals of the cancel amount adjusting variable coil 6 are connected so as to short-circuit the power supply side terminals of the cancel coils 5*a* and 5*b*. The cancel amount adjusting variable coil 6 is divided into two coil portions 6*a* and 6*b* by a slidable adjusting tap 6*c*. The adjusting tap 6*c* is connected to one power supply terminal A.

With the above circuit configuration, the inductances of the coil portions 6*a* and 6*b* of the variable coil 6 are added to the inductances of the cancel coils 5*a* and 5*b*, respectively. Therefore, the total inductance can be appropriately changed by slightly changing the position of the adjusting tap 6*c*, thereby easily performing a fine adjustment to obtain a maximum cancel effect.

As has been described above, according to the present invention, in the deflecting yoke having coils for canceling a low-frequency leakage magnetic field, the adjusting variable tapped coil is connected between the power supply terminals of the pair of cancel coils. Therefore, even if two cancel coils having the same specification are used, their individual inductances can be finely adjusted by moving the variable adjusting tap, thus providing a maximum cancel effect. As a result, two cancel coils having different design specifications need not be prepared, unlike in the conventional deflecting yoke, and designing and manufacturing efficiencies are improved, resulting in a low cost.

What we claim is:

1. A deflecting yoke for a television receiver comprising a parallel circuit of a pair of cancel coils connected in series with a parallel circuit of a pair of horizontal deflecting coils, characterized in that an adjusting variable tapped coil is connected between power supply terminals of said pair of cancel coils to vary the balance of the inductance of the pair of cancel coils connected in parallel one to the other.

2. A deflecting yoke according to claim 1, wherein said adjusting variable coil is a differential coil.

3. A deflecting yoke for a television receiver comprising a parallel circuit of cancel coils connected in series with a parallel circuit of horizontal deflecting coils, power supply means operatively connected to the cancel coils, said power supply means including terminals, and an adjusting variable tapped coil connected between the terminals of the power supply means to vary the balance of the inductance of the pair of cancel coils connected in parallel one to the other.

4. A deflecting yoke as in claim 3 wherein the variable tapped coil includes an adjusting tap, and the variable tapped coil is adjusted by changing the position of the adjusting tap.

5. A deflecting yoke for a television receiver comprising a parallel circuit of cancel coils connected in series with a parallel circuit of horizontal deflecting coils, power supply means operatively connected to the cancel coils, said power supply means including terminals, and an adjusting variable tapped coil connected in series with the cancel coils to vary the balance of the inductance of the pair of cancel coils connected in parallel one to the other.

* * * * *